US005784718A

United States Patent [19]

Finnegan

[11] Patent Number: 5,784,718

[45] Date of Patent: Jul. 28, 1998

[54] SWEATER HAVING AN INSIDE POCKET WITH A DOLL INSIDE THE POCKET AND METHOD

[76] Inventor: Evelyn M. Finnegan, 392 Hatherly Rd., North Scituate, Mass. 02066

[21] Appl. No.: 893,083

[22] Filed: Jul. 15, 1997

Related U.S. Application Data

[63] Continuation-in-part of Ser. No. 43,182, Aug. 28, 1995, Pat. No. Des. 383,286.

[51] Int. Cl.[6] ..... A41D 1/04

[52] U.S. Cl. ..... 2/90; 2/69; 2/247; 446/27

[58] Field of Search ..... 2/69, 49.1, 46, 2/48, 50, 51, 75, 80, 84, 88, 85, 90, 93, 102, 108, 105, 106, 243.1, 244, 246, 247–252, 171; D2/753, 750, 749; 446/28, 27, 26, 327, 328, 329

[56] References Cited

U.S. PATENT DOCUMENTS

| | | | |
|---|---|---|---|
| D. 105,881 | 8/1937 | Langer . | |
| D. 156,420 | 12/1949 | Kaplan | D2/753 |
| 575,726 | 1/1897 | Moon . | |
| 2,628,452 | 2/1953 | Gladstein . | |
| 2,686,313 | 8/1954 | Seidler | 2/75 |
| 2,748,517 | 6/1956 | Berkis | 2/115 X |
| 3,378,852 | 4/1968 | Harter | 2/90 |
| 3,447,165 | 6/1969 | Brosk | 2/75 |
| 4,120,053 | 10/1978 | Nemirofsky . | |
| 4,138,745 | 2/1979 | Greenspan . | |
| 4,710,979 | 12/1987 | Bull et al. | 2/48 |
| 4,874,340 | 10/1989 | Smallwood . | |
| 5,117,507 | 6/1992 | Long | 2/75 X |
| 5,209,691 | 5/1993 | Ekstein | 2/80 X |
| 5,210,881 | 5/1993 | Stocker, Jr. et al. | 2/75 X |
| 5,308,275 | 5/1994 | Kornbleuth | 446/28 |
| 5,477,560 | 12/1995 | Shope | 2/49.1 |
| 5,542,122 | 8/1996 | Moldovan | 2/69 |

OTHER PUBLICATIONS

Spiegel, The Roll–Neck Sweater, 1987, p. 126.

J.C. Penney, Hunt Club Mega Textured Roll Neck Sweater, 1991, p. 18.

J.C. Penney, Cotton Roll–Neck Sweater, 1993, p. 61.

"My Little Friend Goes to a Baseball Game", 1994, Little Friend Press, by Evelyn M. Finnegan.

*Primary Examiner*—Gloria M. Hale

*Attorney, Agent, or Firm*—Richard P. Crowley

[57] ABSTRACT

A sweater having an inside pocket with a doll therein. The sweater having hook and loop tabs to receive the doll in the pocket and to permit a child, on rolling up the front of the sweater, to remove the doll from the inside hidden pocket.

9 Claims, 4 Drawing Sheets

SWEATER HAVING AN INSIDE POCKET WITH A DOLL INSIDE THE POCKET AND METHOD

REFERENCE TO PRIOR APPLICATION

This application is a continuation-in-part of U.S. Design Application Ser. No. 29/043,182, filed Aug. 28, 1995, now U.S. Design Pat. No. D 383,286, issued Sep. 9, 1997.

BACKGROUND OF THE INVENTION

Typically, small children enjoy playing with the doll, and more particularly, to a keep a particular, favorite doll close to their person and readily available for playing, if desired.

It is therefore desirable to provide a child's garment with a hidden pocket for a doll, which doll may be easily removed from the pocket for play by the child, or easily secured within the pocket of the garment by the child.

SUMMARY OF THE INVENTION

The invention relates to a child's upper body garment with a removable/securable doll in a hidden interior pocket and to a method of securing and removing the doll from the hidden pocket.

The invention comprises a child's upper body garment; such as a sweater, with a closed front portion and with a removable/securable doll in a hidden pocket; and which garment comprises an upper body garment; such as a sweater, adapted for use by a child, having a front portion with an exterior surface, a garment interior surface, and a lower portion garment edge, above the lower portion of the upper body garment.

The garment includes a pocket, with an interior pocket space of sufficient size and depth dimensions, to receive therein a small child's doll. The pocket, having a pocket interior surface and an upper pocket edge, is generally positioned on the interior surface and toward the lower front portion of the child's garment, so the pocket and doll may be easily accessible to a child. The garment includes a child's doll, adapted to be placed in the pocket space, and to have the head, with a face and a hat on the head, and generally the arms extending outwardly of the upper pocket edge.

The garment also includes a closure means; such as, but not limited to, an easily removable/securable Velcro® strap-type closure tab, having fabric of opposing hooks and loops to provide for a child to easily secure the doll in the pocket, and with the extended arms aligned with or extending outwardly, generally to the pocket edge, and to easily unsecure the doll by removing the releasable, securable tab, like the Velcro® tab, for removal, for play with the doll. The doll and the hidden pocket is accessible when the lower garment edge is turned upwardly by the child to expose the hidden pocket and doll, for removing the doll from the pocket, or for securing the doll in the pocket.

The closure means to secure the doll in the pocket may vary and particularly comprises an easily releasable, closable means, and more particularly would include a first hook or loop section, with an opposing hook or loop section, such as a Velcro® closure, on opposing tabs, and one tab firmly secured to the outside surface of the hidden pocket, with the Velcro® closure at one end, and the other end secured to the sweater, so that the child may easily unsecure, remove, or separate the Velcro® tabs, and then remove the doll or place the doll back in the hidden pocket, and then secure the tabs in place. Generally, the closure means would include a pair of generally Y-shaped, extending strips with the Velcro® tab at one end, or both ends, and/or at the other end, strips secured to the upper body garment interior surface, and with the Y-shaped strips extending over the arm of the doll, in the hidden secured position, although other closure means may be employed to secure the doll in the hidden pocket.

The invention includes a method for the concealing and removing of a small child's doll, by a child, from a hidden pocket in an interior, lower, front portion of child's upper body garment, such as a sweater.

The method and operation comprises inserting a small doll, having a doll head and arms, and the doll head may have, optionally, a painted face with a long hat on the head, into the interior space of the hidden pocket, on the interior surface of the garment, particularly the lower left or right hand portion of the garment, with the doll head extending above the pocket edge, and therefore visable when the lower garment edge is rolled up by the child to expose the doll. The method includes inverting the lower, front portion of the child's garment, such as rolling up the lower edge to expose the hidden doll in the hidden doll pocket. The method includes releasably unsecuring, by removing a closure means, the doll from the hidden pocket, by the child, and then placing the inverted, lower, front portion of the garment in a normal garment-wearing position to hide the secured doll in the pocket from view by others. The method includes the child periodically inverting the lower, front portion of the child's upper portion body garment to expose the secured hidden doll, such as by rolling up the front, lower portion edge and then removing a portion of the closure means to permit the child to easily remove the doll from the hidden, interior pocket and then placing the inverted lower portion of the child's garment in a normal garment-wearing position with the doll in the pocket, so that the child may then play with the doll, and then repeating the above method by the child, as desired.

The invention will be described for purposes of illustration only, in connection with specific embodiments; however, it is recognized that various modifications, changes, additions and improvements may be made by those persons skilled in the art, without departing from the spirit and scope of the invention as illustrated.

DESCRIPTION OF THE EMBODIENTS

Figure 1:
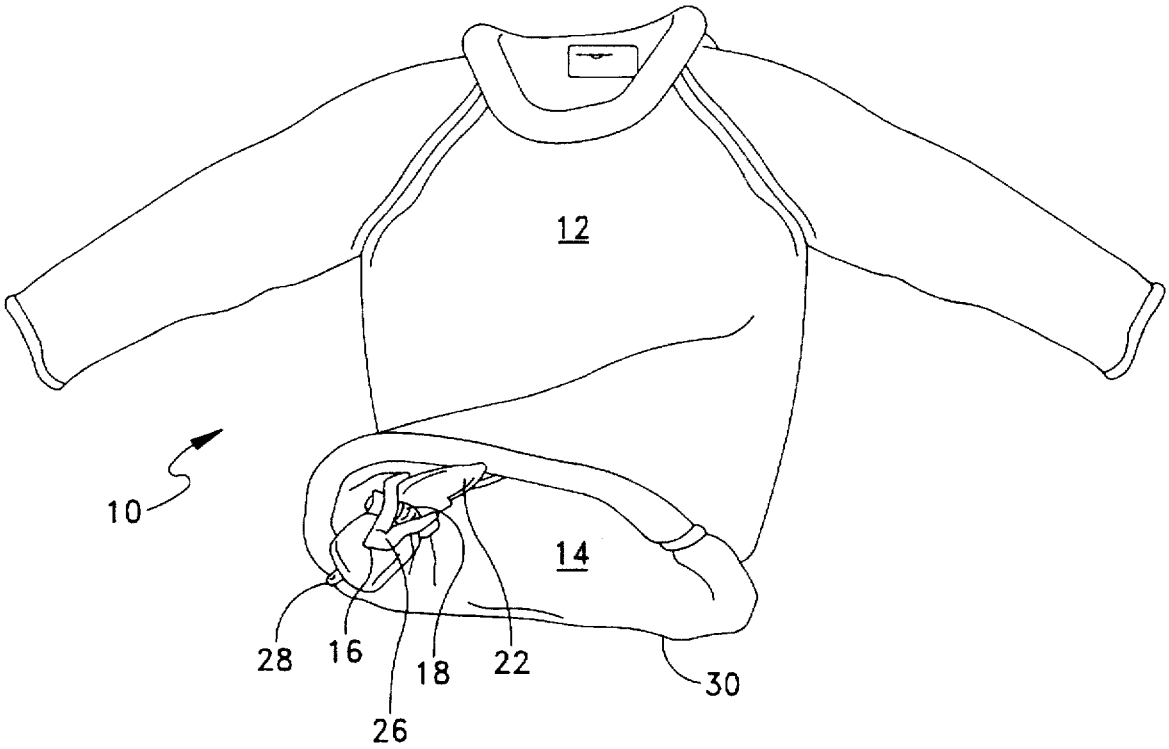
FIG. 1 is a front elevational view of a child's sweater having an inside pocket with a doll in the pocket showing the invention.
Figure 2:
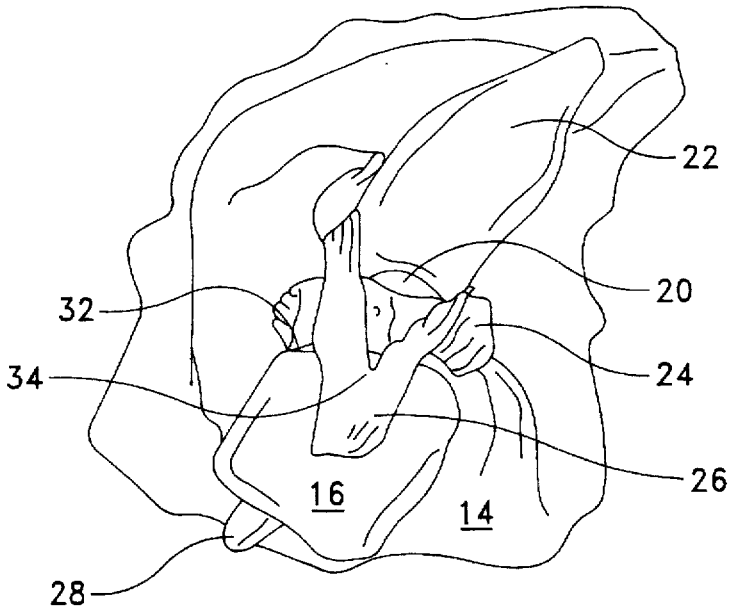
FIG. 2 is a partial, front, enlarged view with the sweater shown cut away for the convenience of illustration.
Figure 3:
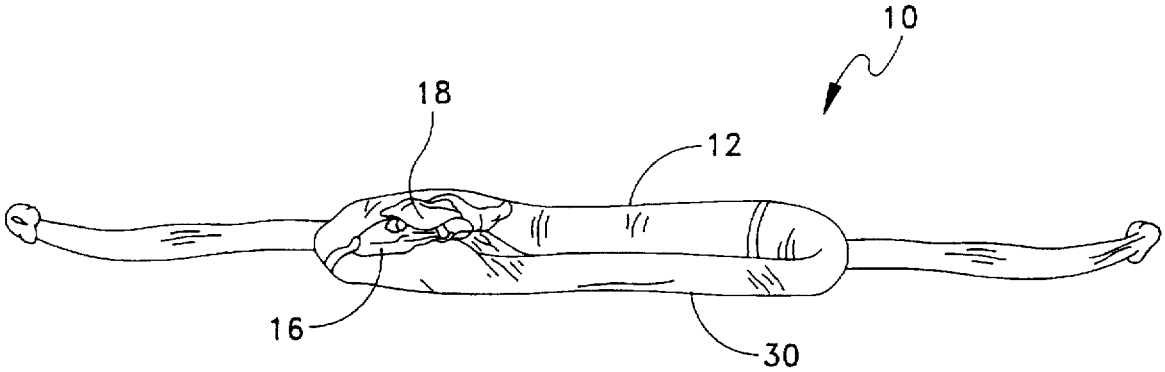
FIG. 3 is a bottom plan view of FIG. 1.

With reference to the drawings, FIG. 1 shows a child's upper body garment 10, such as a sweater, having a front portion 12, an interior surface 14, a hidden, generally rectangular-type pocket 16, with a defining a space sufficiently evolved to receive a doll 18, composed of a doll head 20, and hat 22 on the doll head, and the doll having outwardly extending arms 24, generally extending to the outer edge of the hidden pocket 16. The doll 18, particularly shown in FIGS. 1–4, is positioned and secured in the hidden interior pocket 16 containing a Velcro®-type closure tab 26 with hook and loop on either surface 36 to provide for easy removal by the child of the Velcro® tab or the easy securing of the Velcro® tab 26 in the closed or open position. One of the Velcro® tab hook and loop surfaces is secured to the exterior surface of the hidden pocket 16 at one end of an extending tab 34, wherein the Y-tab extends over both arms 24 of the doll 18 in the secured position and is secured to the sweater 28 at the bottom of the hidden pocket 16. The pocket has an upper pocket edge 32, so that the outwardly extending arms 24 extend outwardly, generally to the pocket edge or slightly beyond, to help secure the doll 18 in a visible condition on the lower garment edge 30 of the front portion of the garment 12 when rolled up by the child and used to expose the doll 18 in the pocket 16 prior to removal.

Figure 8:
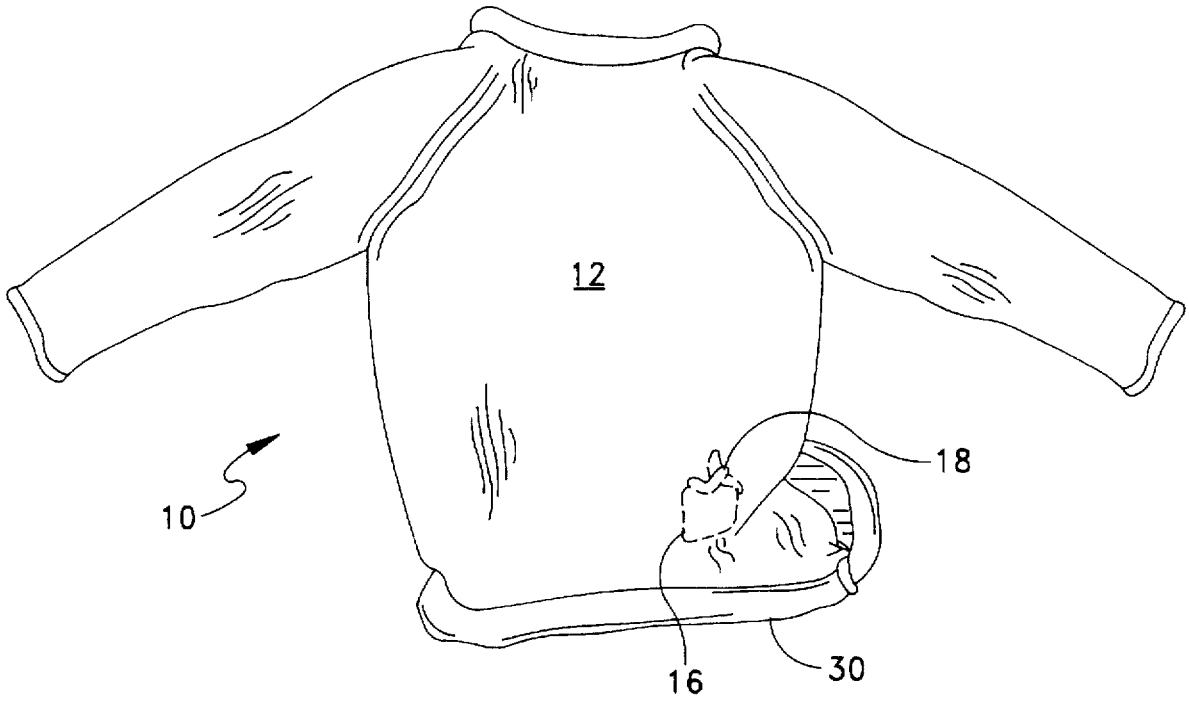
FIG. 8 is a rear elevational view of FIG. 1.

FIG. 8 shows a rear elevational view of the upper body garment 10 of the invention with the hidden pocket 16 and the doll 18 in dotted lines and secured to the lower front interior surface 12 of the garment 10.

Figure 4:
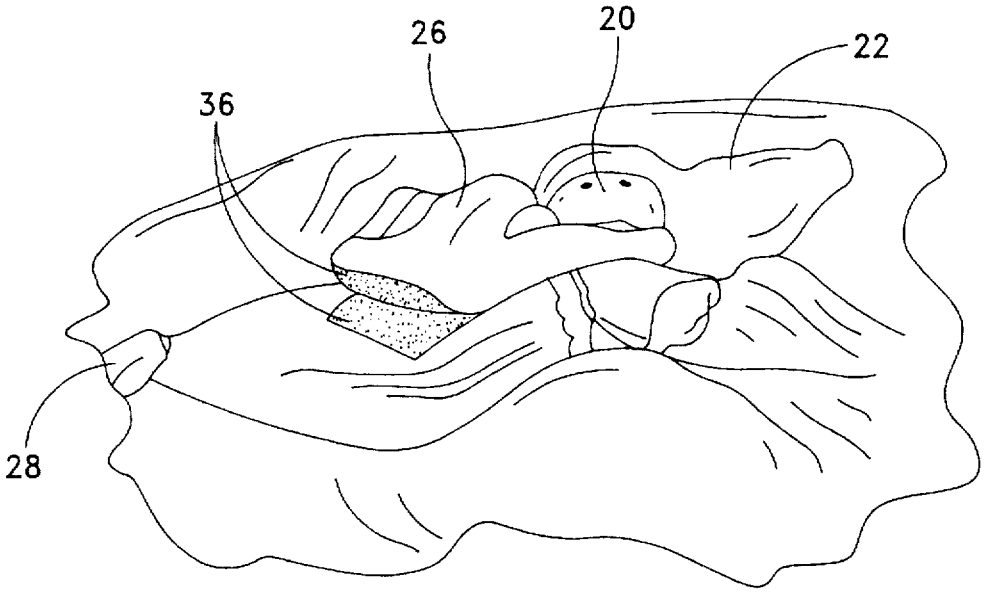
FIG. 4 is a partial, perspective view, with the sweater of FIG. 1 shown cut away for the convenience of illustration.
Figure 5:
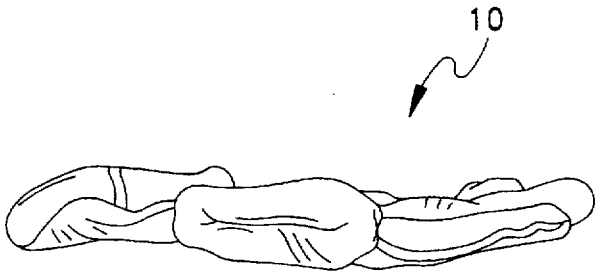
FIG. 5 is a top plan view of FIG. 1.
Figure 6:
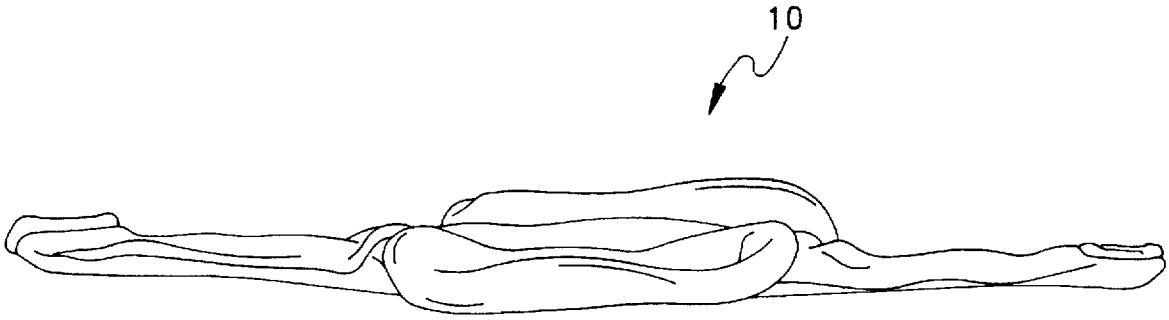
FIG. 6 is a top plan view of FIG. 1, with the arms of the sweater fully extended.
Figure 7:
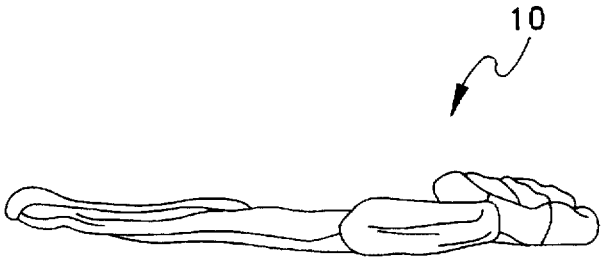
FIG. 7 is a side view of FIG. 1, the opposite side being a mirror image thereof.

FIGS. 1, 2, 3 and 4 show the doll 18 in the hidden pocket 16 in the secured hidden position, with FIG. 4 showing the Velcro® tabs 36 being partially released, as when the child would roll up the front edge 30 of the sweater 10 to expose the hidden pocket and the secured doll, and then pull upwardardly the Velcro® tab surfaces, one surface 36, so as to permit the doll 18 to be removed from the pocket 16, after the Y-tab 26 has been placed over the doll head and the doll removed, and optionally the Velcro® surface then resecured without the doll 18 in the hidden pocket 16.

The child's garment, with the hidden doll pocket and the doll, permits the child to carry the hidden doll with the child and to remove the doll easily, as desired, for separate play.

What is claimed is:

1. A child's upper body garment with a removable/securable doll in a hidden pocket therein, which garment comprises:

a) an upper body garment adapted for use by a child having a front portion with a garment exterior surface, a garment interior surface, and a lower portion garment edge;

b) a pocket having an interior pocket space to receive therein a small child's doll, the pocket having a pocket exterior surface, and an upper pocket edge with ends positioned on the garment interior surface and lower right front portion of said garment;

c) a child's doll adapted to be placed in the pocket space of said pocket, and to have the head and extending arms of the doll extending outwardly above the pocket edge; and d) a closure means having a one end and other end, one end secured to the garment interior surface and the other end secured by detachable, cooperating fasteners to the pocket exterior surface, to provide for a child to secure easily the doll in the hidden pocket when the other end is fastened in place, and to unsecure the doll for removal and play from the hidden pocket, when the other end is unfastened by the child, when the lower garment edge is turned upwardly to expose the hidden pocket.

2. The garment of claim 1 which comprises a sweater having a closed front portion.

3. The garment of claim 1 wherein the doll includes outwardly extending arms which generally extend toward or slightly outwardly of the ends of the pocket edge of the hidden pocket.

4. The garment of claim 3 wherein the doll includes a head, painted face, and a long pointed hat on the head.

5. The garment of claim 1 wherein the cooperative fasteners of the closure means comprises a securable/removable hook and loop-type closure.

6. The garment of claim 1 wherein the closure means includes a Y-shaped closure strap with extending arms and a base, with the arms of the Y strap secured to the interior garment surface above the pocket edge and the arms in the secured position extending on either side of the head of the doll, and the base in the secured position detachably secured, by the cooperative fasteners, to the pocket exterior surface.

7. A method for the concealing and removing of a small child's doll, by a child, from a hidden pocket from the interior, lower, front portion of a child's upper body garment having closure means to secure detachably the doll in the pocket, and which method comprises:

a) inverting the lower, front portion of said garment to expose a hidden pocket in the lower, front, interior portion of the body garment;

b) the child inserting a small doll into an interior space of the hidden pocket, with the doll having a head and arms which extend above the pocket edge;

c) releasably securing, by the child, by the closure means, the doll within the hidden pocket;

d) placing the inverted, lower, front portion of the garment in a normal garment wearing position, to hide the secured doll in the pocket from view;

e) periodically, by the child, inverting the lower front portion of the garment and rolling up the garment edge to expose the secured, hidden doll in the hidden pocket;

f) removing, by the child, the detachable portion of the closure means to permit the child to remove easily the doll from the hidden pocket;

g) placing the inverted, lower, front portion of the garment, after the removal of the doll, by the child, in a normal garment wearing position; and h) repeating the above method, by the child, as desired.

8. The method of claim 7 wherein the child's garment comprises a child's sweater having a closed front portion.

9. The method of claim 7 wherein the closure means comprises a closure strap detachably secured with cooperative fasteners to the exterior pocket surface, and which method includes releasably securing the doll in the hidden pocket by engaging the cooperative fasteners, and removing the closure means to permit the child to remove the doll by the child's detaching the cooperative fasteners.

* * * * *